US010541472B2

(12) United States Patent
Rose

(10) Patent No.: US 10,541,472 B2
(45) Date of Patent: Jan. 21, 2020

(54) BEAM FORMING WITH A PASSIVE FREQUENCY DIVERSE APERTURE

(71) Applicant: Evolv Technologies, Inc., Waltham, MA (US)

(72) Inventor: Alec Rose, West Hartford, CT (US)

(73) Assignee: Evolv Technologies, Inc., Waltham, MA (US)

( * ) Notice: Subject to any disclaimer, the term of this patent is extended or adjusted under 35 U.S.C. 154(b) by 385 days.

(21) Appl. No.: 14/603,028

(22) Filed: Jan. 22, 2015

(65) Prior Publication Data

US 2015/0207224 A1 Jul. 23, 2015

Related U.S. Application Data

(60) Provisional application No. 61/930,363, filed on Jan. 22, 2014.

(51) Int. Cl.
*H01Q 3/22* (2006.01)
*H01Q 15/00* (2006.01)
(Continued)

(52) U.S. Cl.
CPC ..... *H01Q 3/22* (2013.01); *H01Q 15/0086* (2013.01); *H01Q 15/02* (2013.01); *H01Q 15/148* (2013.01); *H01Q 19/06* (2013.01)

(58) Field of Classification Search
CPC ..... H01Q 3/22; H01Q 15/0086; H01Q 15/02; H01Q 15/148; H01Q 19/06; H01Q 3/2676;
(Continued)

(56) References Cited

U.S. PATENT DOCUMENTS 3,041,450 A * 6/1962 Parker ..... H04B 14/004 331/96
3,546,705 A * 12/1970 Lemson ..... H01Q 21/26 343/797
(Continued)

FOREIGN PATENT DOCUMENTS

EP 1566859 A2 8/2005
WO WO-2002/023671 A2 3/2002

OTHER PUBLICATIONS

Lipworth et al. "Metamaterial Apertures for Coherent Computational Imaging on the Physical Layer." *J. Opt. Soc. Am. A.* 30.8(2013):1603-1612.
(Continued)

*Primary Examiner* — Bernarr E Gregory
*Assistant Examiner* — Nuzhat Pervin
(74) *Attorney, Agent, or Firm* — Mintz Levin Cohn Ferris Glovsky and Popeo, P.C.

(57) ABSTRACT

A system includes a frequency modulated signal generator, a feed system, and an array of passive antenna elements. The frequency modulated signal generator can be producing a frequency modulated continuous wave signal. The feed system can be coupled to the frequency modulated signal generator for propagating the frequency modulated continuous wave signal. The array of passive antenna elements can be coupled to the feed system and can be configured to be excited by the frequency modulated continuous wave signal. The passive antenna elements can have resonant frequencies that are selected to generate a set of radiative field patterns corresponding to a set of known goal field patterns when the array of passive antenna elements are excited by the frequency modulated continuous wave signal. Related apparatus, systems, techniques, and articles are also described.

17 Claims, 7 Drawing Sheets

(51) Int. Cl.
*H01Q 15/02* (2006.01)
*H01Q 15/14* (2006.01)
*H01Q 19/06* (2006.01)

(58) Field of Classification Search
CPC .. H01Q 3/42; H01Q 3/44; H01Q 3/46; H01Q 25/008; H04B 14/04; H04B 1/7174; G01S 7/038; G01S 7/2813; G01S 13/343; G01S 13/48; G01S 7/4008; G01V 15/00; G02F 1/0126; H01P 7/08
USPC ..... 342/372
See application file for complete search history.

(56) References Cited

U.S. PATENT DOCUMENTS 4,271,413 A * 6/1981 Shreve ..... H01Q 3/2676 342/196
4,682,175 A * 7/1987 Lazarus ..... G01S 7/038 342/122
4,700,179 A * 10/1987 Fancher ..... G01V 15/00 340/572.2
4,868,574 A * 9/1989 Raab ..... G01S 13/66 342/81
5,008,677 A * 4/1991 Trigon ..... G01S 7/2813 342/17
5,497,157 A * 3/1996 Gruener ..... G01S 13/343 342/29
5,861,845 A * 1/1999 Lee ..... H01Q 3/22 342/374
5,945,938 A * 8/1999 Chia ..... G01S 13/756 342/42
5,952,964 A * 9/1999 Chan ..... H01Q 3/22 342/368
5,955,992 A * 9/1999 Shattil ..... H04B 1/7174 342/372
6,091,371 A * 7/2000 Buer ..... H01Q 3/44 343/754
6,768,456 B1 * 7/2004 Lalezari ..... G01S 13/48 342/373
6,888,887 B1 * 5/2005 Shattil ..... H04B 1/7174 332/112
7,106,494 B2 * 9/2006 Osipov ..... G02F 1/0126 257/17
7,205,941 B2 * 4/2007 Wang ..... H01Q 3/44 343/700 MS
7,567,202 B2 * 7/2009 Pearson ..... G01S 7/4008 342/100
7,791,552 B1 * 9/2010 Romanofsky ..... H01Q 3/46 343/700 MS
7,994,969 B2 * 8/2011 Van Caekenberghe ... G01S 7/03 342/107
8,587,469 B2 * 11/2013 Bruno ..... G01S 7/36 342/16
8,643,536 B2 * 2/2014 Cavirani ..... G01S 7/024 342/118
8,922,422 B2 * 12/2014 Klar ..... G01S 7/4004 342/175
9,070,972 B2 * 6/2015 Wang ..... G01S 13/34
9,136,571 B2 * 9/2015 Papziner ..... G01S 7/032
9,190,717 B2 * 11/2015 Schoeberl ..... G01S 7/03
9,425,512 B2 * 8/2016 Maruyama ..... H01Q 21/0018
9,531,079 B2 * 12/2016 Maruyama ..... H01Q 15/148
2002/0109633 A1 * 8/2002 Ow ..... H01Q 9/0407 343/700 MS
2003/0184477 A1 * 10/2003 Shafai ..... H01Q 3/34 343/700 MS
2003/0202794 A1 * 10/2003 Izadpanah ..... H01Q 3/2676 398/115
2009/0096545 A1 * 4/2009 O'Hara ..... H01P 7/08 332/129
2013/0335256 A1 * 12/2013 Smith ..... G01S 13/887 342/22

OTHER PUBLICATIONS

Hunt, John. *Metamaterials for Computational Imaging*. Diss. Duke U, 2013. N.p.: n.p., n.d. Print.

* cited by examiner

BEAM FORMING WITH A PASSIVE FREQUENCY DIVERSE APERTURE

RELATED APPLICATION

This application claims priority under 35 U.S.C. § 119 to U.S. Provisional Patent Application No. 61/930,363 filed Jan. 22, 2014, the entire contents of which are hereby expressly incorporated by reference herein.

TECHNICAL FIELD

The subject matter described herein relates to beam forming with a passive and frequency diverse aperture.

BACKGROUND

Beam forming or spatial filtering is a technique used in sensor arrays for directional signal transmission or reception. Regularly spaced elements in an active phased array can be combined in such a way that signals at particular angles experience constructive interference while others experience destructive interference. Beam forming can be used for both transmission and reception.

SUMMARY

In an aspect, a system includes a frequency modulated signal generator, a feed system, and an array of passive antenna elements. The frequency modulated signal generator can be producing a frequency modulated continuous wave signal. The feed system can be coupled to the frequency modulated signal generator for propagating the frequency modulated continuous wave signal. The array of passive antenna elements can be coupled to the feed system and can be configured to be excited by the frequency modulated continuous wave signal. The passive antenna elements can have resonant frequencies that are selected to generate a set of radiative field patterns corresponding to a set of known goal field patterns when the array of passive antenna elements are excited by the frequency modulated continuous wave signal.

In another aspect, data can be received using at least one data processor. The data can characterize a set of goal field patterns for an array of passive antenna elements. Using the received data and the at least one data processor, resonant frequencies can be determined for the passive antenna elements such that, when the passive antenna elements are excited by a frequency modulated continuous wave signal received from a feed system, the array of passive antenna elements emits a set of radiative field patterns corresponding to the set of goal field patterns. Using the at least one data processor, the resonant frequencies can be provided.

In yet another aspect, an array of antennas includes a plurality of passive antenna elements adjacent a feed system and configured to be excited by a frequency modulated continuous wave signal delivered by the feed system. The passive antenna elements can have diverse resonant frequencies selected to generate a set of radiative field patterns corresponding to a set of known goal field patterns when the array of passive antenna elements are excited by the frequency modulated continuous wave signal.

In yet another aspect, a system can include means for producing a frequency modulated continuous wave signal, means for propagating the frequency modulated continuous wave signal, and means for generating a set of radiative field patterns. The set of radiative field patterns can correspond to a set of known goal field patterns when the means for generating is excited by the frequency modulated continuous wave signal.

One or more of the following features can be included in any feasible combination. For example, the feed system can include a parallel plate waveguide and one or more coaxial cables. The parallel plate waveguide can be adjacent the array of passive antenna elements. The parallel plate waveguide can include one or more feed pins. The one or more coaxial cables can be coupled to the one or more feed pins.

The resonant frequencies of the passive antenna elements can be selected such that, at a particular excitation frequency of the frequency modulated continuous wave signal, a subset of antenna elements in the array of passive antenna elements produce a radiative field pattern that is within an error criterion of one of the set of known goal field patterns. The error criterion can be a measure of similarity between the radiative field pattern and one of the set of known goal field patterns. The error criterion can be determined based on an element-by-element product between radiative field patterns of the passive antenna elements and the set of known goal field patterns. The resonant frequencies of the passive antenna elements can be selected to maximize a weighting matrix characterizing a similarity between the set of radiative field patterns and the set of known goal field patterns.

The array of passive antenna elements can include metamaterials formed on a surface of a printed circuit board. The array of passive antenna elements can include a plurality of panels that are configurable to be spatially arranged and oriented with respect to one another. The passive antenna elements can be narrow-band with respect to an operating frequency range of the frequency modulated continuous wave signal and the feed system can include one or more of: a propagation delay and/or a filter.

The resonant frequencies of the passive antenna elements can be determined such that, at a particular excitation frequency of the frequency modulated continuous wave signal, a subset of antenna elements in the array of passive antenna elements produce a radiative field pattern that is within an error criterion of one of the set of goal field patterns. The error criterion can be a measure of similarity between the radiative field pattern and one of the set of goal field patterns. The error criterion can be determined based on an element-by-element product between radiative field patterns of the passive antenna elements and the set of goal field patterns. The resonant frequencies of the passive antenna elements can be determined to maximize a weighting matrix characterizing a similarity between the set of radiative field patterns and the set of goal field patterns. The resonant frequencies can be determined subject to physical constraints, wherein the physical constraints prevent antenna elements from overlapping, and limit a number of antenna elements that can have a given resonant frequency.

The array of antenna elements having the determined resonant frequencies can be printed on a printed circuit board and using metamaterials.

The means for generating can produce a radiative field pattern that is within an error criterion of one of the set of known goal field patterns. The error criterion can be a measure of similarity between the radiative field pattern and one of the set of known goal field patterns. The error criterion can be determined based on an element-by-element product between radiative field patterns of a plurality of passive antenna elements and the set of known goal field patterns.

Non-transitory computer program products (i.e., physically embodied computer program products) are also described that store instructions, which when executed by one or more data processors of one or more computing systems, causes at least one data processor to perform operations herein. Similarly, computer systems are also described that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including but not limited to a connection over a network (e.g. the Internet, a wireless wide area network, a local area network, a wide area network, a wired network, or the like), via a direct connection between one or more of the multiple computing systems, etc.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

The current subject matter relates to beam forming in an aperture composed of passive and frequency diverse antenna elements. For any arbitrary desired field pattern, the resonant frequencies of the antenna elements may be selected so that, when the antenna elements are excited or activated by a feeding network, the antenna elements that are radiating substantial energy are antenna elements with a phase and amplitude distribution that matches the desired field pattern.

While beam forming can be implemented using an active phased array, forming multiple beams using a single passive device can be a challenge. For example, one can consider a passive device that simultaneously distributes a common driving signal to an array of antennas. Changing the beam pattern of such an array requires a change in radiating phase and/or amplitude of the antennas relative to one another. In lieu of active components, such as amplifiers and phase-shifters, this can be achieved by designing frequency diversity into either the feed network, which simultaneously distributes the common driving signal to each antenna, or into the antennas themselves, or both. Thus, for a different driving frequency, such a system can project very different field patterns, for example, towards a receiver for communication, or towards some set of scattering objects for imaging, and different information can be encoded or measured by each distinct field pattern. However, making such a system compact, as well as mapping a large number of desired field patterns to a single device, can be prohibitively challenging.

Figure 1:
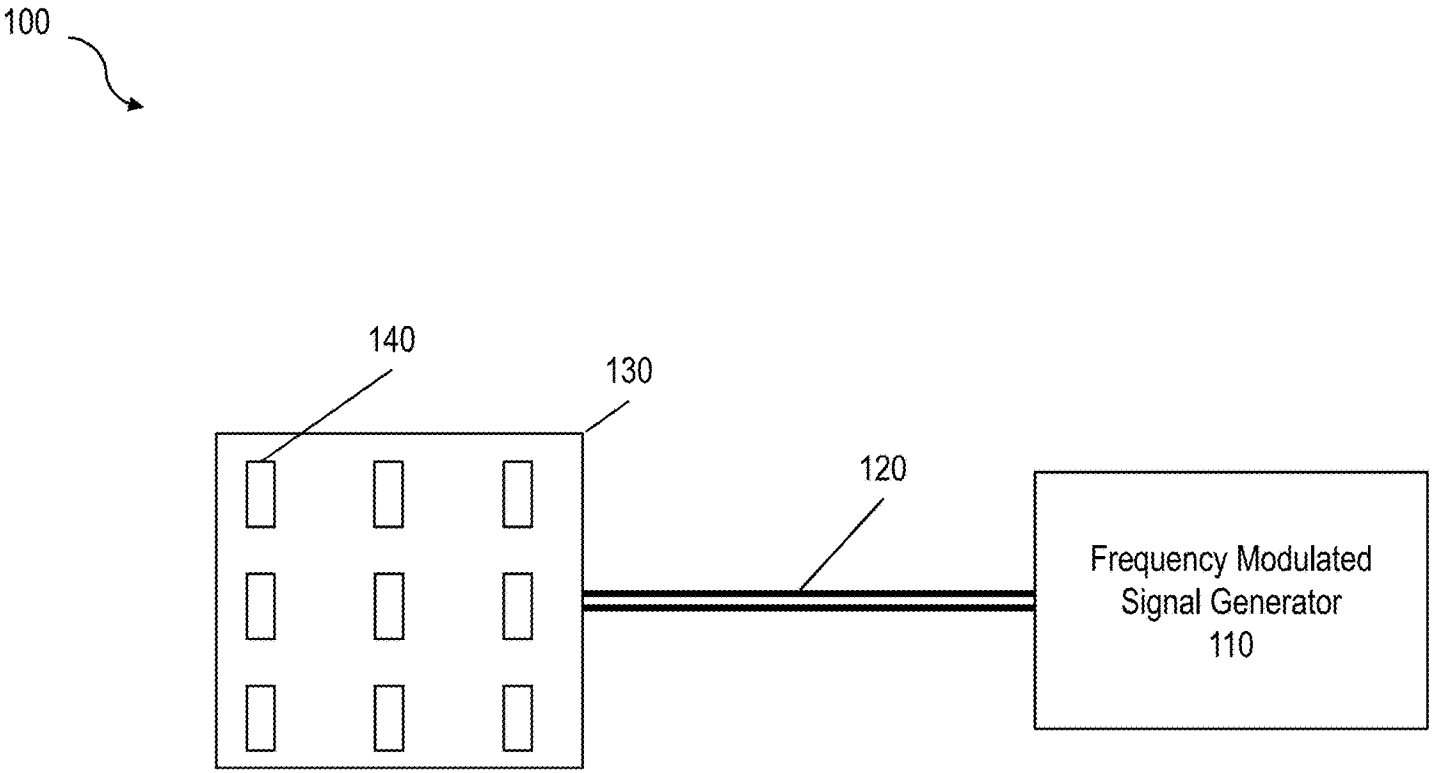
FIG. 1 is a system block diagram illustrating a frequency diverse system that generates a set of radiative field patterns corresponding to a set of known goal field patterns.

FIG. 1 is a system block diagram illustrating a frequency diverse system 100 that generates a set of radiative field patterns that correspond to a set of known goal field patterns. Frequency diverse system 100 can include, for example, a radar or communications system that utilizes beam forming for operation. Frequency diverse system 100 can include frequency modulated signal generator 110, feed system 120, and array 130 including multiple passive antenna elements 140.

Frequency modulated signal generator 110 can produce a frequency modulated continuous wave signal (FMCW). The FMCW signal can be a sinusoidal chirp that sweeps or varies between a low and high frequency (e.g., increasing in frequency or decreasing in frequency). A variety of modulations is possible, for example, sinewave, saw tooth wave, triangle wave, square wave, and the like. Other implementations are possible.

Figure 2:
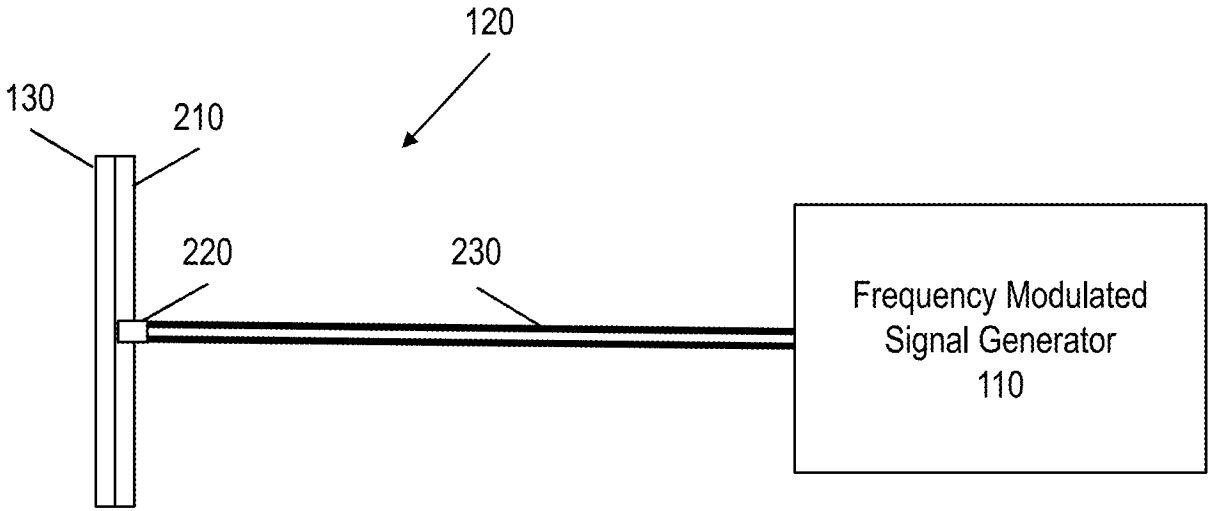
FIG. 2 is a side view of the array and feed system.

Feed system 120 can be coupled to frequency modulated signal generator 110 and can propagate the FMCW signal to array 130. FIG. 2 is a side view of array 130 and feed system 120. The feed system 120 can include a parallel plate waveguide 210 with one or more feed pins 220. The feed pin 220 can be located substantially in the center of the parallel plate waveguide 210. In some implementations, there can be multiple feed pins 220 that are distributed throughout the parallel plate waveguide 210. Feed system 120 can include one or more coaxial cables 230 connecting feed pin 220 and frequency modulated signal generator 110. Parallel plate waveguide 210 can be adjacent array 130 to enable excitation of antenna elements 140 of array 130. Feed system 120 can vary across the operating frequency range to introduce frequency diversity by varying propagation lengths from the feed pin 220 to each element of array 130, by introducing filtering or scattering elements between the feed pin 220 and elements of array 130 or within waveguide 210, or by a combination of propagation delays and filters.

Referring again to FIG. 1, array 130 includes multiple passive antenna elements 140. Antenna elements 140 can be passive and frequency diverse and may be excited by the FMWC signal. Passive antenna elements 140 can include elements without an integrated amplification stage. In some implemenations, passive antennas are individual antennas that do not have an individual amplifier and phase shifter, although the system may have one or more amplifiers upstream (e.g., towards frequency modulated signal generator 110 and before feed system 120) Frequency diverse antenna elements 140 can include elements whose relative radiating phase and/or amplitude changes as a function of frequency. In some implementations, each antenna element 140 can be narrow-band with respect to an operating frequency range of the FMCW signal. In addition, transmission by frequency diverse system 100 at two frequencies that are separated by more than a bandwidth of the antenna elements 140 may be distinct, that is, not correlated.

In some implementations, array 130 can be highly configurable, and can generate many distinct phase and/or amplitudes of fields at the various antenna elements 140 making up array 130. In some implementations, this can be achieved by making antenna elements 140 narrow band with feed system 120 that is, by comparison, slow but varying across the entire bandwidth, for example, by varying propagation lengths from the feed pin 220 to elements of array 130, by introducing filtering or scattering elements between the feed pin 220 and elements of array 130 or within waveguide 210, or by a combination of propagation delays and filters. Alternatively, in some implementations, antenna elements 140 can be broadband, while feed system 120 and FMCW signal rapidly sweeps through various phase and/or amplitude excitations at each antenna element 140 by the use of varying propagation delays, or filters and/or scattering elements in the feed network.

Figure 3:
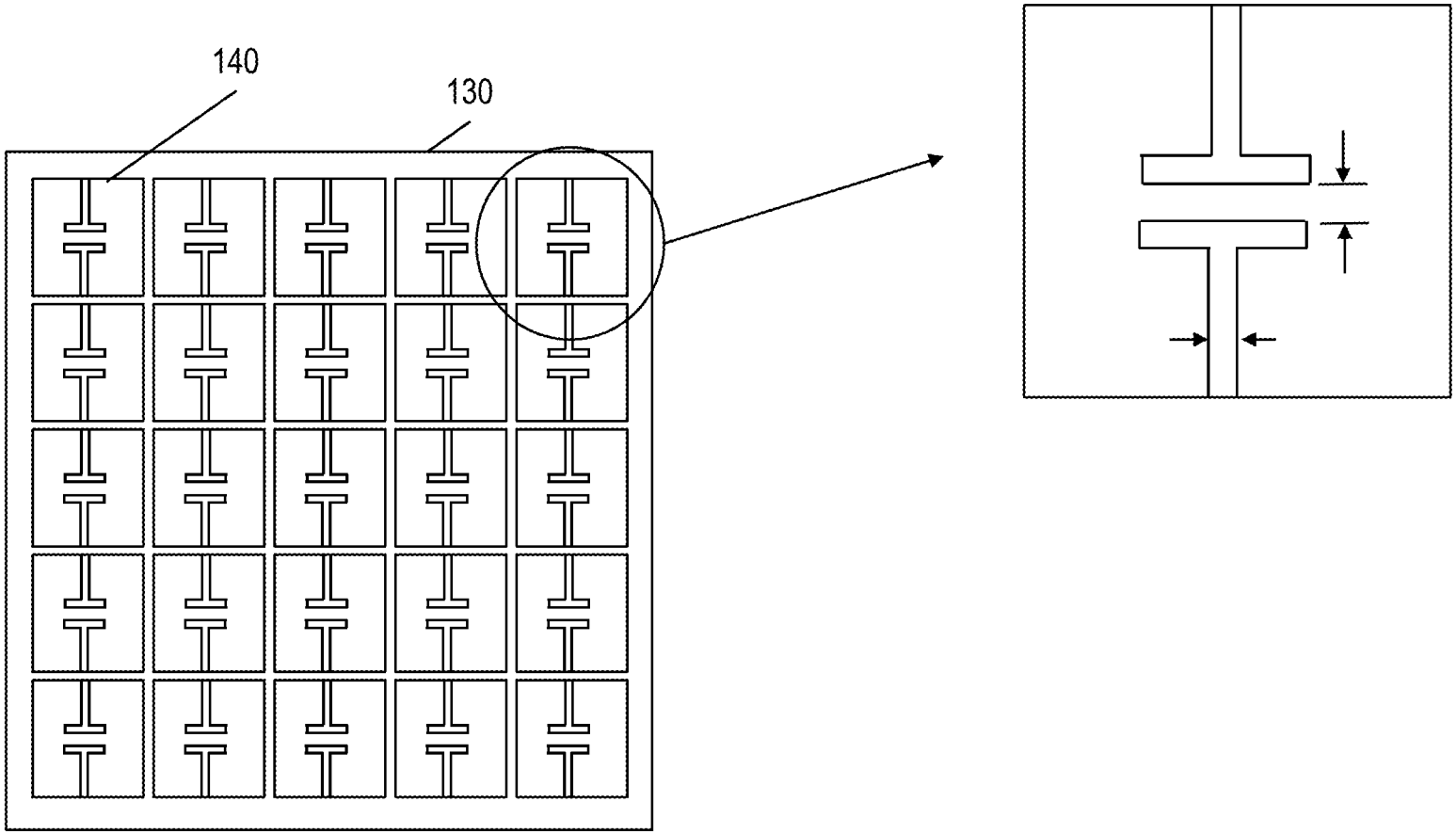
FIG. 3 is a close up view of the array according to an example implementation of the current subject matter.

FIG. 3 is a close up view of array 130 according to an example implementation of the current subject matter. Antenna elements 140 can be formed of metamaterials, which can generally be artificial materials engineered to have special properties. For example, a metamaterial may include assemblies of multiple individual elements fashioned from conventional materials such as metals, but the materials can be constructed into repeating patterns, often with microscopic structures. Metamaterials derive their properties from their structures. Their precise shape, geometry, size, orientation, and arrangement can lead to negative permeability and other interesting properties. In addition, the metamaterials may be printed on a printed circuit board using photolithography techniques.

As illustrated in FIG. 3, antenna elements 140 can be formed as complementary electric-inductive-capacitive resonators. The resonant frequency of each antenna element 140 can be controlled by controlling the materials, shape (including width, length, thickness, and the like), and arrangement of the components (including distance between) of the complementary electric-inductive-capacitive resonators.

Figure 4:
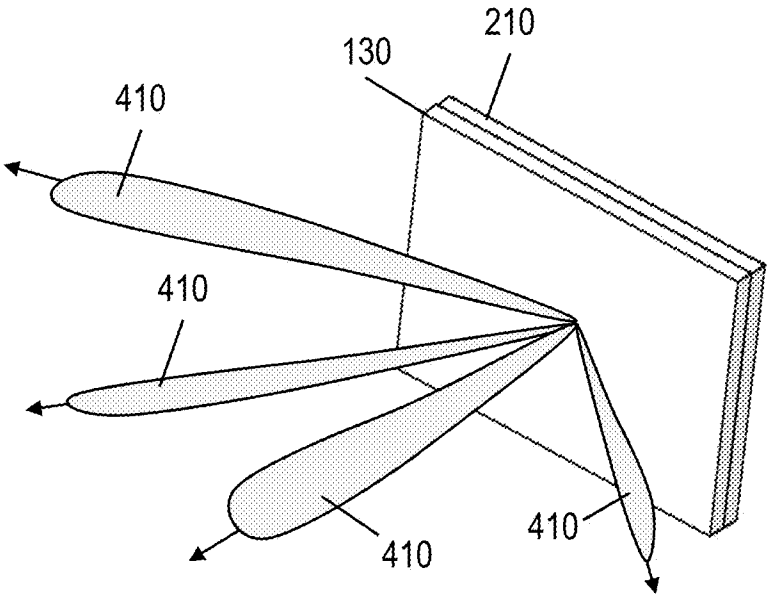
FIG. 4 is a perspective view of an array and illustrated goal field patterns.

Passive antenna elements 140 can have diverse resonant frequencies selected to generate a set of radiative field patterns that correspond to a set of known goal field patterns. The goal field patterns may be any arbitrary set of field patterns. For example, FIG. 4 is a perspective view of array 130 with goal field patterns 410 illustrated.

Knowing the set of goal field patterns 410, passive antenna elements 140 can be configured in a manner that they generate a set of radiative field patterns (e.g., field patterns that are radiated from the array 130) corresponding to the set of known goal field patterns 410. Antenna elements 140 can be selected or configured such that, at a particular excitation frequency of the FMCW, a subset of antenna elements 140 in array 130 produce a radiative field pattern that is within an error criterion of one of the set of known goal field patterns 410.

The error criterion may be, for example, a measure of similarity between the radiative field pattern and the desired goal field pattern 410. For example, the error criterion may include a weighting matrix that characterizes a similarity between the amplitude and phase of antenna elements and the goal field pattern on an element-by-element basis. As an example, at a particular element, $X_j$, and frequency $f_i$, the known phase and amplitude distribution can be given by $P_{ij}$. $G_{ij}$ can give the goal field pattern at this element and frequency. A "good match" between an element's amplitude and phase and the goal field pattern can be related to their element-by-element product, given by the weighting matrix $W_{ij}=RE[G_{ij}P_{ij}]$. The larger the value of $W_{ij}$, the closer match between known phase and amplitude distribution at a given frequency and antenna element location. The resonant frequencies of antenna elements 140 can be configured to maximize the weighting matrix $W_{ij}$ subject to physical system constraints for a given set of goal field patterns. The physical system constraints can include directivity, overlap, a limit to the number of antenna elements 140 having a given resonant frequency, and the like.

Thus, the error criterion can be a threshold value or characterization of how "closely" the goal field pattern matches the achieved radiative field pattern. In addition, the value of the error criterion can vary based on a given application. The actual value of the error criterion can characterize an acceptable deviation from the goal field pattern.

In some implementations, array 130 can include two or more panels of antenna elements 140 that are separate from one another and can be positioned separately and/or independently.

Figure 5:
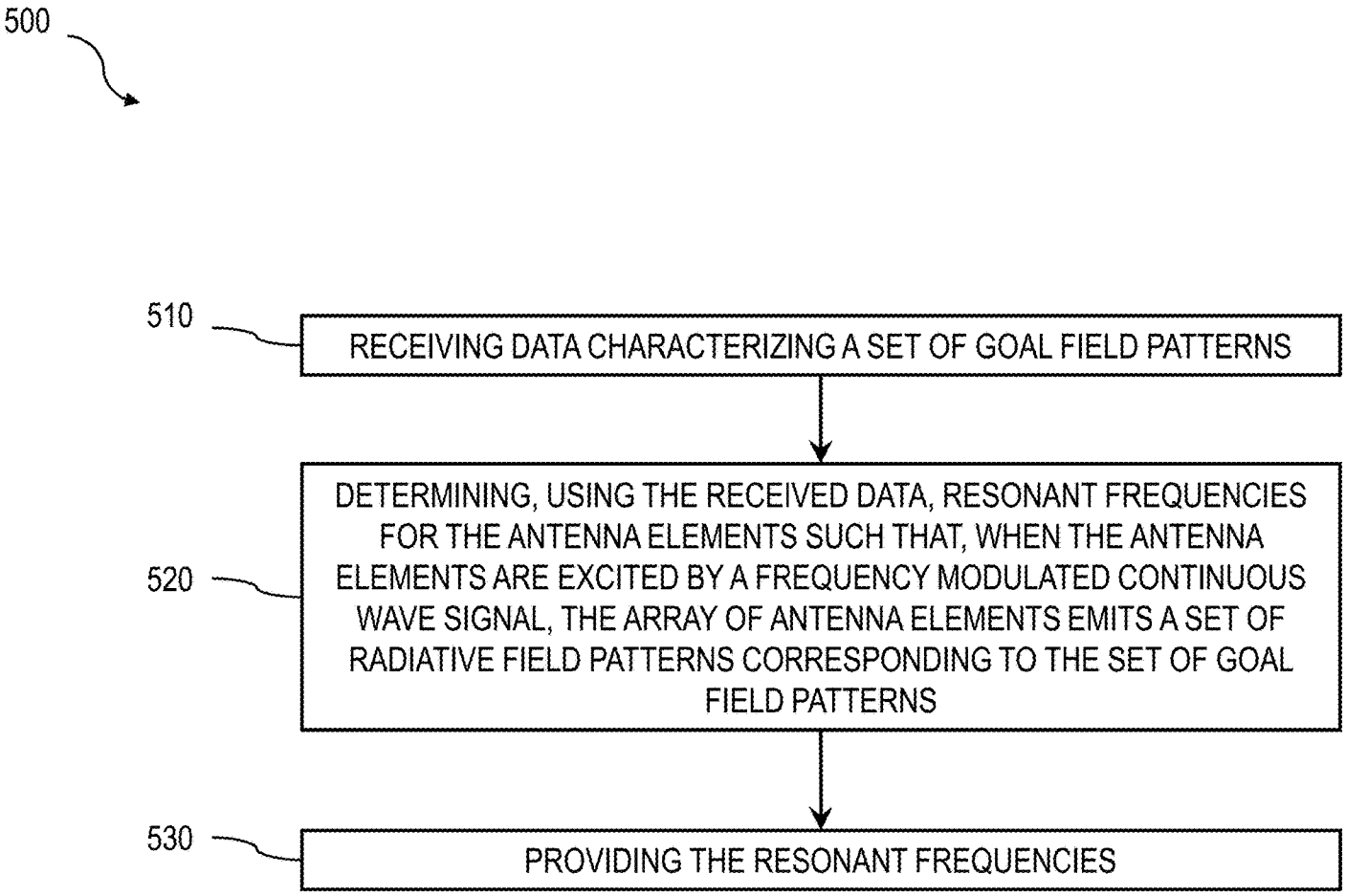
FIG. 5 is a process flow diagram illustrating a method of optimizing an array design for a list of goal field patterns.

FIG. 5 is a process flow diagram illustrating a method 500 of optimizing an array design for a list of goal field patterns.

At 510, data characterizing a set of goal field patterns is received. The set of goal field patterns may include any number of goal field patterns. In some implementations, physical system constraints can also be received.

At 520, resonant frequencies for the antenna elements are determined such that, when the antenna elements are excited by a FMCW signal received from a feed system, the array of antenna elements emits a set of radiative field patterns corresponding to the set of goal field patterns.

The resonant frequencies of the antenna elements can be determined such that, at a particular excitation frequency of the FMCW signal, a subset of antenna elements in the array produce a radiative field pattern that is within an error criterion of one of the set of goal field patterns. The error criterion can be a measure of similarity between the radiative field pattern and one of the set of goal field patterns. In some implementations, the resonant frequencies of the antenna elements can be determined to maximize a weighting matrix characterizing a similarity between the set of radiative field patterns and the set of known goal field patterns.

At 530, the resonant frequencies can be provided. Providing can include transmitting, storing, and processing the resonant frequencies. In some implementations, antenna element characteristics, such as width, length, depth, and shape of split ring resonators can be determined. In some implementations, the array of antenna elements having the determined resonant frequencies can be printed on a printed circuit board using metamaterials.

Figure 6A:
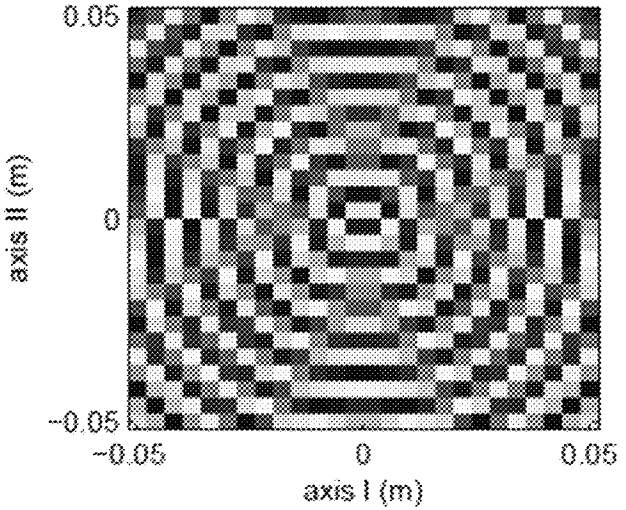
FIG. 6A is a surface plot illustrating a known emitted field distribution of a square array of antenna elements that sits atop a ground plan and are fed by an underlying parallel plate waveguide.

FIG. 6A-6D and FIG. 7 illustrate an example array design according to the current subject matter. FIG. 6A is a surface plot illustrating a known emitted field distribution of a square array of antenna elements that sits atop a ground plan and are fed by an underlying parallel plate waveguide, akin to a leaky-wave array of antennas. The waveguide is fed by a single central pin, which may, for example, include a coaxial cable incorporated into the bottom of the waveguide. This would result in a wave whose phase progresses radially outward from the center pin, as illustrated in FIG. 6A. By tuning each element of the array to some resonant frequency within the overall bandwidth, the array would emit some pseudo-random field distribution, such that the fields emitted at two frequencies separated by more than the bandwidth of the individual elements would have little to no correlation, and thus be distinct.

Figure 6B:
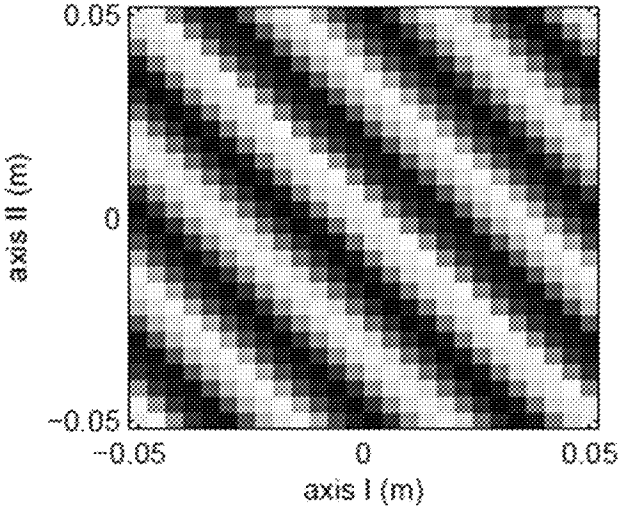
FIG. 6B is a surface plot illustrating an example goal function in which the amplitude is constant but the phase varies along a particular direction.
Figure 6C:
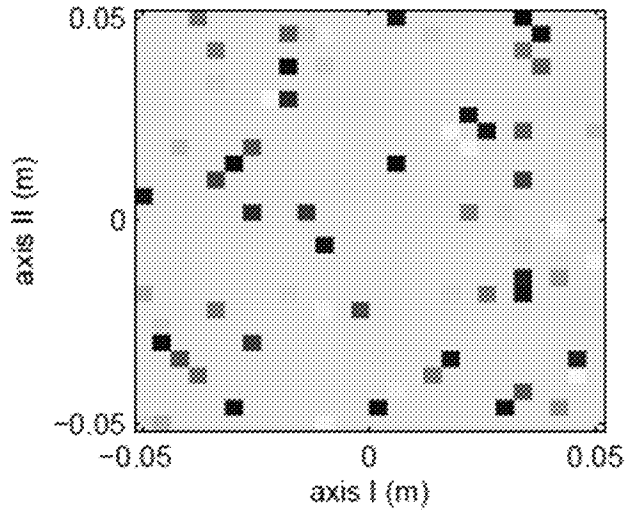
FIG. 6C is a surface plot illustrating a subset of elements in the array whose phases match an example goal function.
Figure 6D:
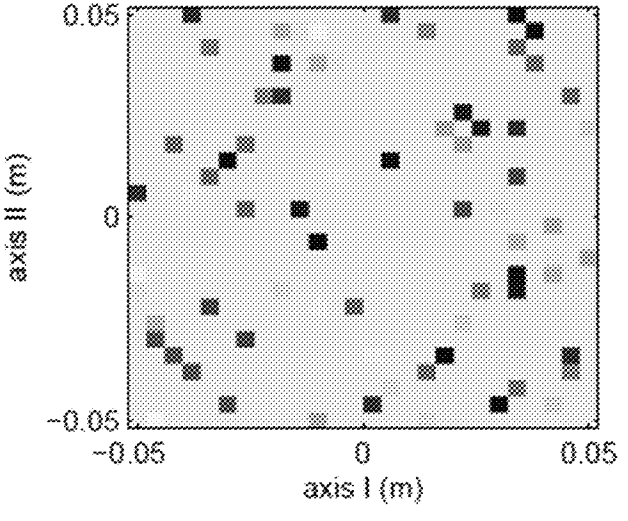
FIG. 6D is a surface plot illustrating the phase of an example goal function at the same subset of elements given in FIG. 6C.

While pseudo-random directional field generation can be good for some applications, it can be desirable to have control over the field distributions, or at least impose certain constraints, such as directivity, overlap, and the like. As an example, consider an arbitrary set of goal field patterns, or specific relative amplitude and phase distributions that can be labeled $G_i$, where i labels the frequency, $f_i$, of the goal distribution. As an example, FIG. 6B is a surface plot illustrating an example goal field pattern in which the amplitude is constant but the phase varies along a particular direction, such that the expected far-field distribution is a beam at a particular angle. The known emitted field distribution (FIG. 6A) does not match the example goal field pattern (FIG. 6B) over the entire array. However, there is a subset of elements in the array whose phases do match the desired goal distribution. For example, FIG. 6C is a surface plot illustrating a subset of elements in the array whose phases match the example goal field pattern (FIG. 6B) and FIG. 6D is a surface plot illustrating another subset of elements in the array whose phases matched the desired goal field pattern (FIG. 6B).

Thus, the resonance frequencies of each element can be selected such that, at a particular frequency, the only elements that are radiating significant energy follow a phase and amplitude distribution that matches the goal field pattern as closely as possible, within the constraints of the system.

In order to determine how to arrange the location and resonance frequencies of each antenna element, a weighting matrix can be used. More specifically, at a particular element, $X_j$, and frequency $f_i$, the feed system is responsible for a phase and amplitude distribution, given by. Meanwhile, the goal field pattern at this element and frequency is given by $G_{ij}$. A 'good match' between an element's amplitude and phase and the goal field pattern is related to their element-by-element product, given by the weighting matrix $W_{ij}$=Re $[G_{ij}W_{ij}]$. Any large entry in $W_{ij}$ indicates a good match between the feed system and goal field pattern at that frequency and location, such that it is likely desirable to set the resonance of the element at location $X_j$ to be $f_i$.

Figure 7:
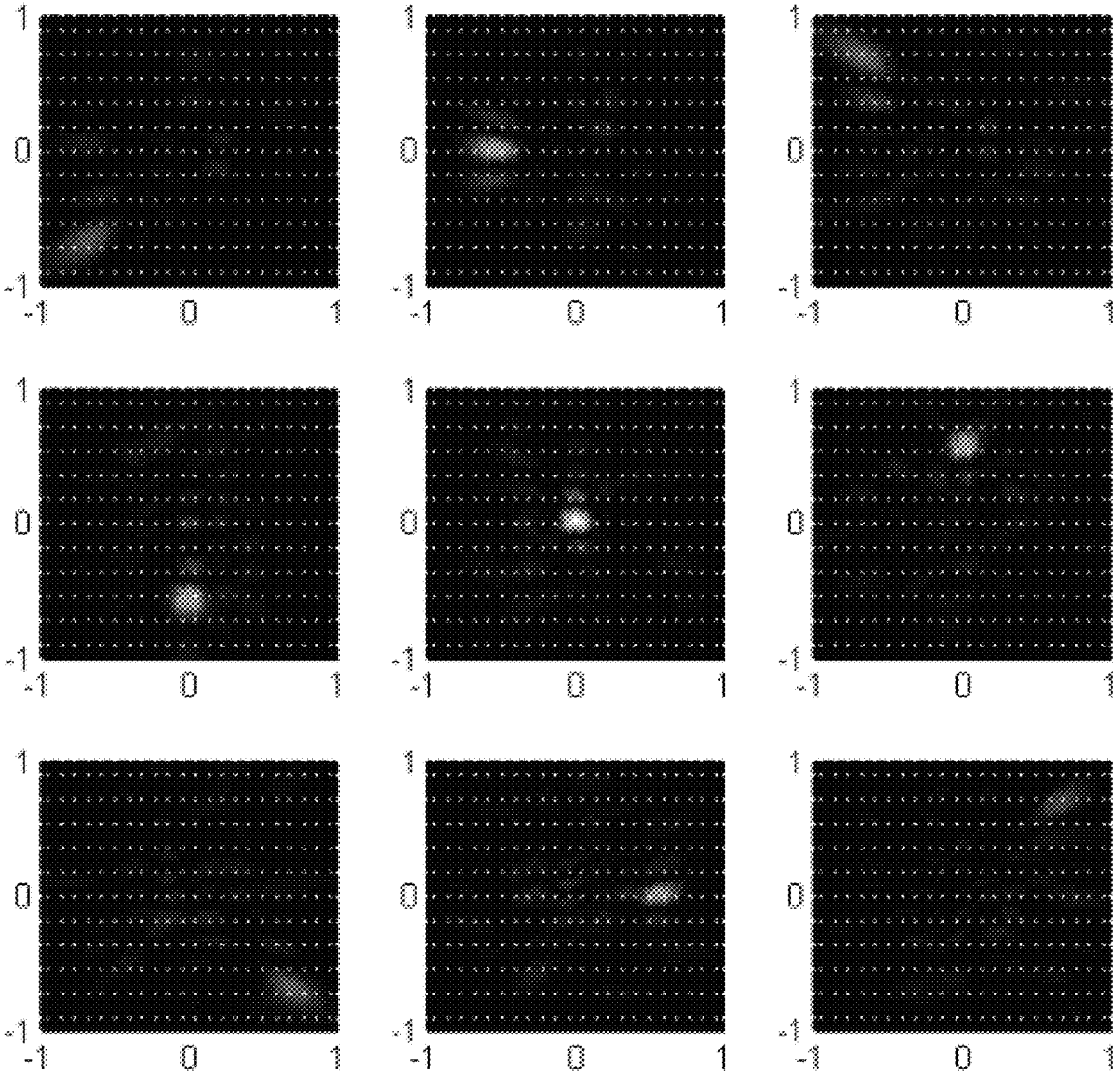
FIG. 7 is a series of surface plots illustrating the attainable field patterns or distributions according to an example implementation of the current subject matter.

While there may be different schemes for assigning optimal resonance frequencies to antenna elements to maximize the matching or similarity between the realized field distributions and the goal field patterns, an approach can include setting the resonance frequency of the antenna $X_j$ equal to the frequency that maximizes $W_{ij}$ along that column, subject to the constraint that no one resonant frequency is assigned to an unreasonably large number of antennas. As an example, FIG. 7 is a series of surface plots illustrating the attainable field patterns or distributions that result from setting the resonance frequency of the antenna $X_{ij}$ equal to the frequency that maximizes $W_{ij}$ along that column and using an aperture as described with reference to FIGS. 6A-6D. In addition, the example goal field patterns used comprise a 3×3 grid of angular projections, across an operating frequency band from 18 to 26 G.Hz. As illustrated in FIG. 7, the attainable field patterns reasonably match the goal field patterns. The current subject matter is not limited to 9 goal field patterns simultaneously but can attain larger numbers of goal field patterns. The number of goal field patterns attainable may be limited by the available bandwidth and the bandwidth of the individual antennas. In addition, matching between goal field patterns and realized field patterns or distributions may be improved by including enough antennas such that each goal field pattern is adequately sampled.

Although a few variations have been described in detail above, other modifications or additions are possible. For example, the number of antenna elements, the range of operating frequencies, the number of discrete antenna panels, and the number of goal field patterns are not limited. In addition, the method of feeding the antenna elements can be modified to incorporate alternate waveguides, such as rectangular waveguides, microstrip, co-planar, and the like, and can take on various feed geometries, such as stacked 1D waveguides, spiral waveguides, and the like.

Without in any way limiting the scope, interpretation, or application of the claims appearing below, a technical effect of one or more of the example implementations disclosed herein may include one or more of the following, for example, beam characteristics of a generated field can be designed for an array of antennas that would otherwise generate pseudo-random field patterns or distributions. A set of goal field patterns can be mapped to a particular frequency range for any number of feed and antenna elements.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software, and the like.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A method comprising:

receiving, using at least one data processor, data characterizing a first amplitude and phase distribution and a second amplitude and phase distribution, the first amplitude and phase distribution associated with a first radiative field pattern to be a radiated by one or more passive antenna elements when arranged within an antenna array including the one or more passive antenna elements and the second amplitude and phase distribution associated with a feed system coupled to the one or more passive antenna elements arranged within the antenna array;

receiving, using the at least one data processor, an error criterion, the error criterion characterizing an amount of deviation between the first amplitude and phase distribution and an amplitude and phase distribution associated with a field pattern radiated by the one or more passive antenna elements when arranged within an antenna array;

determining, using the received data and the at least one data processor, a resonant frequency for the one or more passive antenna elements based on determining an element by element product of the first amplitude and phase distribution and the amplitude and phase distribution associated with the field pattern radiated by the one or more passive antenna elements when arranged within an antenna array is within the error criterion, the resonant frequency characterizing a peak frequency response of the passive antenna element; and manufacturing the antenna array including the one or more passive antenna elements by at least controlling a metamaterial structure of the one or more passive antenna elements so as to configure the one or more passive antenna elements to radiate the determined resonant frequency.

2. The method of claim 1, wherein the resonant frequencies are determined such that, at a particular excitation frequency of a frequency modulated continuous wave signal driving the one or more passive antenna elements, a subset of the one or more passive antenna elements in the antenna array produce a second radiative field pattern that is within the error criterion of the first radiative field pattern.

3. The method of claim 2, wherein the error criterion is a measure of similarity between the second radiative field pattern and the first radiative field pattern.

4. The method of claim 2, wherein the resonant frequency is determined to maximize a weighting matrix characterizing a similarity between the second radiative field pattern and the first field pattern.

5. The method of claim 1, wherein the resonant frequency is determined subject to physical constraints, wherein the physical constraints prevent two antenna elements from overlapping and limit a number of antenna elements that have a given resonant frequency.

6. The method of claim 1, wherein the feed system comprises:

a parallel plate waveguide adjacent the antenna array, the parallel plate waveguide including one or more feed pins; and one or more coaxial cables coupled to the one or more feed pins.

7. The method of claim 1, wherein manufacturing the antenna array includes printing, on a printed circuit board and using the controlled metamaterial structure, the antenna array.

8. A non-transitory computer readable storage medium comprising executable instructions which when executed by at least one data processor forming part of at least one computing system, result in operations comprising:

receiving, using at least one data processor, data characterizing a first amplitude and phase distribution and a second amplitude and phase distribution, the first amplitude and phase distribution associated with a first radiative field pattern to be a radiated by one or more passive antenna elements when arranged within an antenna array including the one or more passive antenna elements and the second amplitude and phase distribution associated with a feed system coupled to the one or more passive antenna elements arranged within the antenna array;

receiving, using the at least one data processor, an error criterion, the error criterion characterizing an amount of deviation between the first amplitude and phase distribution and an amplitude and phase distribution associated with a field pattern radiated by the one or more passive antenna elements when arranged within an antenna array;

determining, using the received data and the at least one data processor, a resonant frequency for the one or more passive antenna elements based on determining an element by element product of the first amplitude and phase distribution and the amplitude and phase distribution associated with the field pattern radiated by the one or more passive antenna elements when arranged within an antenna array is within the error criterion, the resonant frequency characterizing a peak frequency response of the passive antenna element; and manufacturing the antenna array including the one or more passive antenna elements by at least controlling a metamaterial structure of the one or more passive antenna elements so as to configure the one or more passive antenna elements to radiate the determined resonant frequency.

9. The non-transitory computer readable storage medium of claim 8, wherein the resonant frequencies are determined such that, at a particular excitation frequency of a frequency modulated continuous wave signal driving the one or more passive antenna elements, a subset of the one or more passive antenna elements in the antenna array produce a second radiative field pattern that is within the error criterion of the first radiative field pattern.

10. The non-transitory computer readable storage medium of claim 9, wherein the error criterion is a measure of similarity between the second radiative field pattern and the first radiative field pattern.

11. The non-transitory computer readable storage medium of claim 9, wherein the resonant frequency is determined to maximize a weighting matrix characterizing a similarity between the second radiative field pattern and the first field pattern.

12. The non-transitory computer readable storage medium of claim 8, wherein the resonant frequency is determined subject to physical constraints, wherein the physical constraints prevent two antenna elements from overlapping and limit a number of antenna elements that have a given resonant frequency.

13. The non-transitory computer readable storage medium of claim 8, wherein the feed system comprises:

a parallel plate waveguide adjacent the antenna array, the parallel plate waveguide including one or more feed pins; and one or more coaxial cables coupled to the one or more feed pins.

14. The non-transitory computer readable storage medium of claim 8, wherein manufacturing the antenna array includes printing, on a printed circuit board and using the controlled metamaterial structure, the antenna array.

15. A method comprising:

receiving, using at least one data processor, data characterizing a first amplitude and phase distribution and a second amplitude and phase distribution, wherein the first amplitude and phase distribution is associated with a first radiative field pattern to be a radiated by one or more passive antenna elements when arranged within an antenna array including the one or more passive antenna elements and the second amplitude and phase distribution is associated with a feed system coupled to the one or more passive antenna elements arranged within the antenna array;

receiving, using the at least one data processor, an error criterion, the error criterion characterizing an amount of deviation between the first amplitude and phase distribution and an amplitude and phase distribution associated with a field pattern radiated by the one or more passive antenna elements when arranged within an antenna array;

determining, using the received data and the at least one data processor, a resonant frequency for one or more passive antenna elements based on determining an element by element product of the first amplitude and phase distribution and the amplitude and phase distribution associated with the field pattern radiated by the one or more passive antenna elements when arranged within an antenna array is within the error criterion, wherein the resonant frequencies are determined such that, at a particular excitation frequency of a frequency modulated continuous wave signal driving the one or more passive antenna elements, a subset of the one or more antenna elements in the antenna array produce a second radiative field pattern within the error criterion of the first radiative field pattern, wherein the resonant frequency is determined to maximize a weighting matrix characterizing a similarity between the second radiative field pattern and the first field pattern, the resonant frequency characterizing a peak frequency response of the passive antenna element; and printing, on a printed circuit board and using metamaterials, the antenna array including the one or more antenna elements by at least controlling a metamaterial structure of the one or more passive antenna elements during printing so as to configure the one or more passive antenna elements to the determined resonant frequency, wherein controlling the metamaterial structure includes controlling a shape of the one or more passive antenna elements to form a repeatable microscopic structure, controlling a size of the one or more passive antenna elements to form a repeatable microscopic structure, controlling a geometry of the one or more passive antenna elements to form a repeatable microscopic structure, or controlling an orientation of the one or more passive antenna elements to form a repeatable microscopic structure.

16. The method of claim 1, wherein controlling the metamaterial structure of the one or more passive antenna elements includes controlling a shape of the one or more passive antenna elements to form a repeatable microscopic structure, controlling a size of the one or more passive antenna elements to form a repeatable microscopic structure, controlling a geometry of the one or more passive antenna elements to form a repeatable microscopic structure, or controlling an orientation of the one or more passive antenna elements to form a repeatable microscopic structure.

17. The non-transitory computer readable storage medium of claim 8, wherein controlling the metamaterial structure of the one or more passive antenna elements includes controlling a shape of the one or more passive antenna elements to form a repeatable microscopic structure, controlling a size of the one or more passive antenna elements to form a repeatable microscopic structure, controlling a geometry of the one or more passive antenna elements to form a repeatable microscopic structure, or controlling an orientation of the one or more passive antenna elements to form a repeatable microscopic structure.

* * * * *